US010095148B2

(12) United States Patent
Kitagawa et al.

(10) Patent No.: US 10,095,148 B2
(45) Date of Patent: Oct. 9, 2018

(54) CHARGING DEVICE INCLUDING FIRST AND SECOND CLEANING MEMBERS FOR CLEANING A CHARGING WIRE

(71) Applicant: FUJI XEROX CO., LTD., Tokyo (JP)

(72) Inventors: Yusuke Kitagawa, Kanagawa (JP); Sadao Okano, Kanagawa (JP); Yasuo Takayama, Kanagawa (JP); Akiko Kimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/665,818

(22) Filed: Aug. 1, 2017

(65) Prior Publication Data

US 2018/0095377 A1 Apr. 5, 2018

(30) Foreign Application Priority Data

Oct. 4, 2016 (JP) ..... 2016-196608

(51) Int. Cl.
*G03G 15/02* (2006.01)

(52) U.S. Cl.
CPC ..... *G03G 15/0225* (2013.01); *G03G 15/0258* (2013.01); *G03G 15/0291* (2013.01); *G03G 2215/027* (2013.01)

(58) Field of Classification Search
CPC ..... G03G 15/0225; G03G 15/0258; G03G 15/0291
USPC ..... 399/100
See application file for complete search history.

(56) References Cited

U.S. PATENT DOCUMENTS 4,956,671 A * 9/1990 Otsuka ..... G03G 15/0258 399/100
5,687,054 A * 11/1997 Takada et al. ..... G03G 15/0258 399/100
7,769,315 B2 * 8/2010 Tanaka ..... G03G 15/0258 399/100
8,145,090 B2 * 3/2012 Tanase ..... G03G 15/0258 399/100

FOREIGN PATENT DOCUMENTS

JP H05-323772 A 12/1993
JP H07-199605 A 8/1995

* cited by examiner

*Primary Examiner* — William J Royer
(74) *Attorney, Agent, or Firm* — Oliff PLC

(57) ABSTRACT

A charging device includes a first cleaning member that cleans a surface of a charging wire by moving along the wire while being in contact with the wire at a first side; and a second cleaning member that cleans the surface of the wire by moving while being in contact with the wire at a second side, and moving relative to the first cleaning member in a crossing direction that crosses a wire length direction.

5 Claims, 10 Drawing Sheets

CHARGING DEVICE INCLUDING FIRST AND SECOND CLEANING MEMBERS FOR CLEANING A CHARGING WIRE

CROSS-REFERENCE TO RELATED APPLICATIONS

This application is based on and claims priority under 35 USC 119 from Japanese Patent Application No. 2016-196608 filed Oct. 4, 2016.

BACKGROUND

Technical Field

The present invention relates to a charging device and an image forming apparatus.

SUMMARY

According to an aspect of the invention, there is provided a charging device including a first cleaning member that cleans a surface of a charging wire by moving along the wire while being in contact with the wire at a first side; and a second cleaning member that cleans the surface of the wire by moving while being in contact with the wire at a second side, and moving relative to the first cleaning member in a crossing direction that crosses a wire length direction.

BRIEF DESCRIPTION OF THE DRAWINGS

An exemplary embodiment of the present invention will be described in detail based on the following figures, wherein.

DETAILED DESCRIPTION

Figure 1:
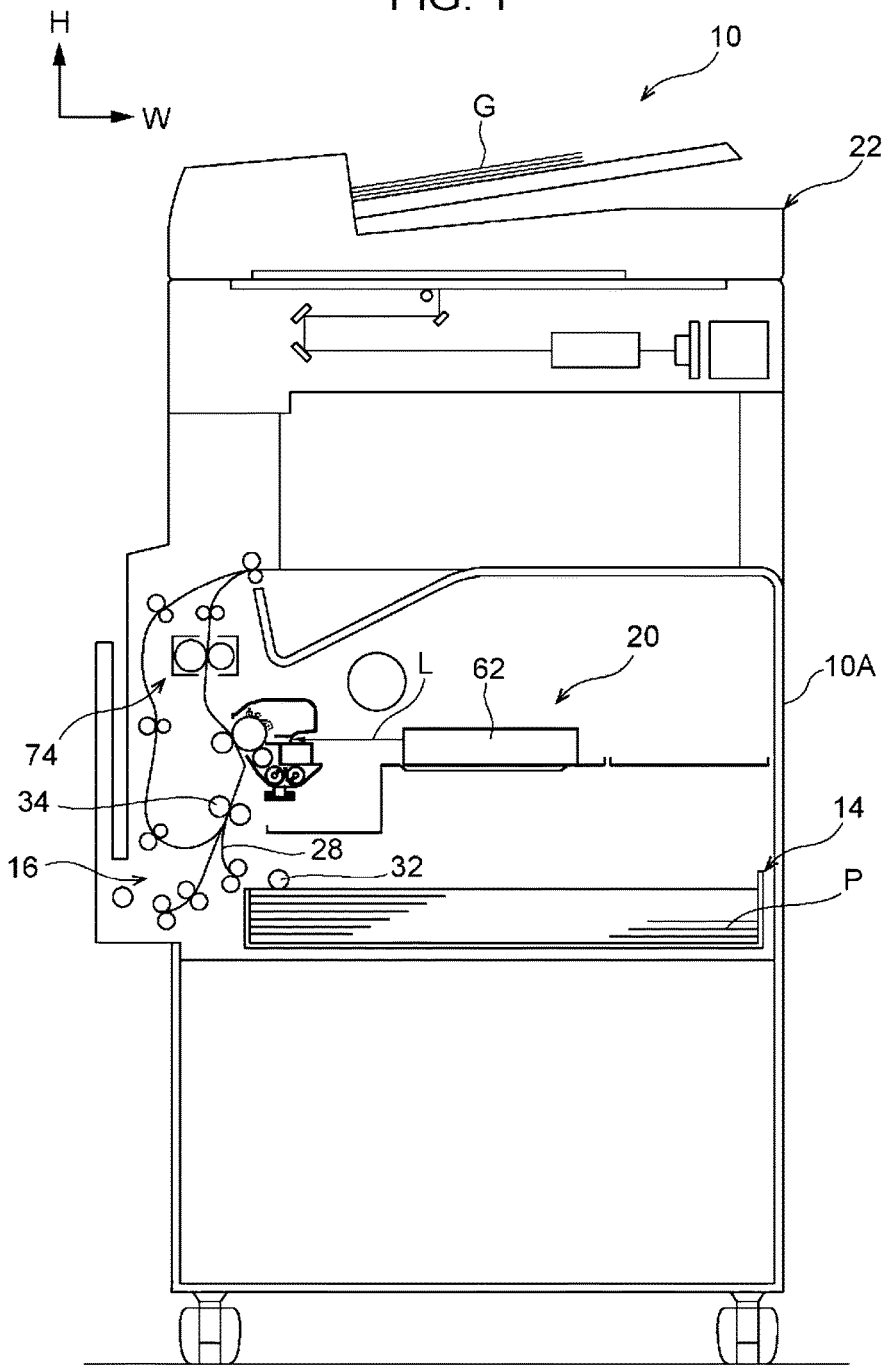
FIG. 1 is a schematic diagram illustrating an image forming apparatus according to an exemplary embodiment.

An example of an image forming apparatus including a charging device according to an exemplary embodiment of the present invention will be described with reference to FIGS. 1 to 10C. In the drawings, arrow H indicates an apparatus up-down direction (vertical direction), arrow W indicates an apparatus width direction (horizontal direction), and arrow D indicates an apparatus depth direction (horizontal direction).

Overall Structure

An image forming apparatus 10 according to the present exemplary embodiment is an electrophotographic image forming apparatus that uses developer containing negatively charged toner and magnetic carrier. As illustrated in FIG. 1, the image forming apparatus 10 includes a storage section 14 in which sheet members P are stored; a transport section 16 that transports each of the sheet members P stored in the storage section 14; an image forming section 20 that forms an image on the sheet member P that is transported; and an image reading section 22 that reads an image on a document G.

Transport Section

The transport section 16 includes plural transport rollers 34 that transport the sheet member P fed by a feeding roller 32 along a transport path 28.

Image Forming Section

Figure 2:
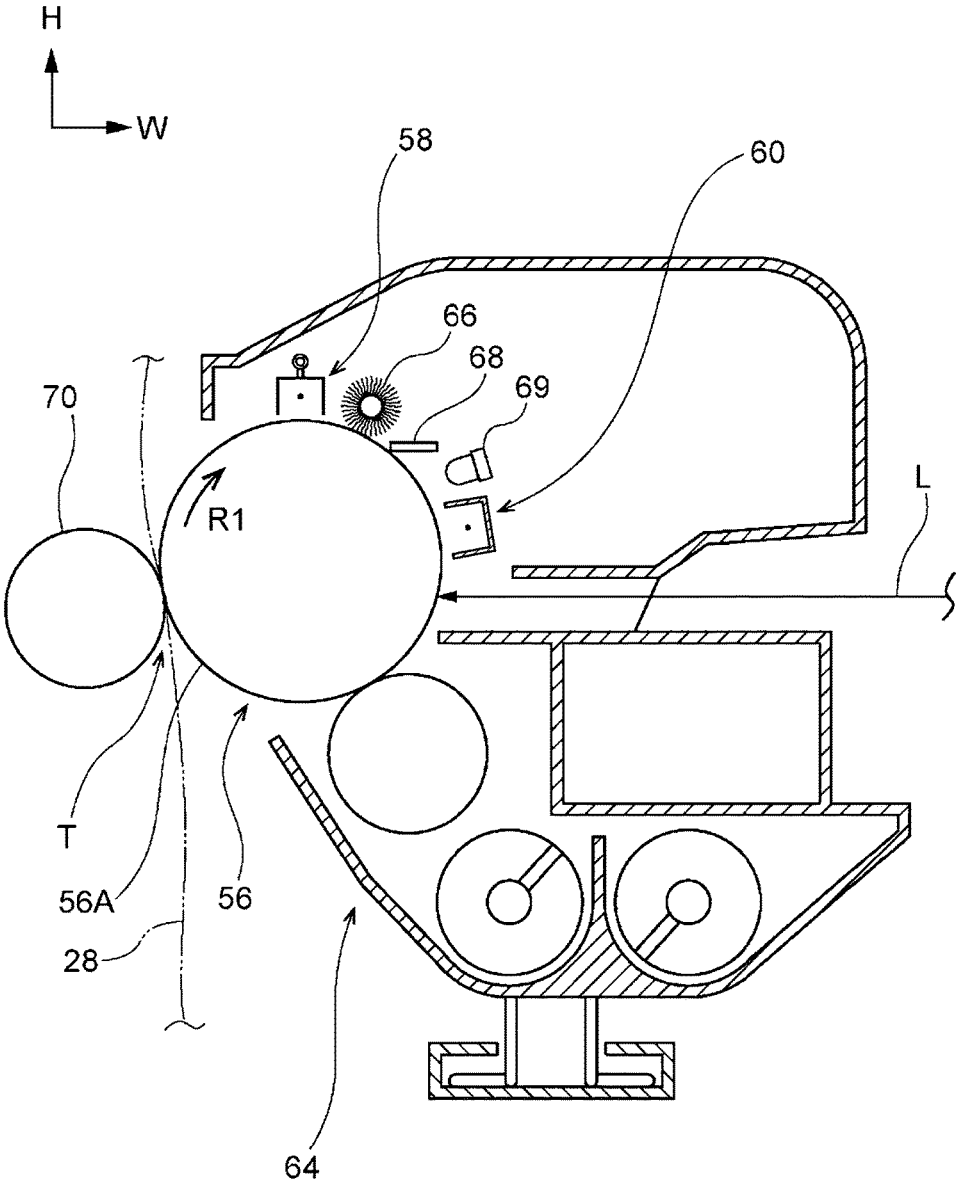
FIG. 2 is a schematic diagram illustrating an image forming unit according to the exemplary embodiment.

As illustrated in FIG. 2, the image forming section 20 includes a cylindrical image carrier 56 that extends in the apparatus depth direction D and rotates in the direction of arrow R1 (clockwise) in FIG. 2. The image forming section 20 also includes a pre-charging device 58, which is an example of a charging device that pre-charges an outer peripheral surface 56A of the image carrier 56 to a negative potential. The image forming section 20 also includes a charge eliminating device 69 including a light emitting element that reduces a negative potential difference of the outer peripheral surface 56A of the image carrier 56 that has been pre-charged by the pre-charging device 58, and sets the potential to about zero.

The image forming section 20 also includes a charging device 60 that charges the surface at which the charge has been eliminated by the charge eliminating device 69 to a negative potential within a predetermined range. The image forming section 20 also includes an exposure device 62 (see FIG. 1) that forms an electrostatic latent image by irradiating the outer peripheral surface 56A of the image carrier 56 charged by the charging device 60 with exposure light L, and a developing device 64 that develops the electrostatic latent image formed on the outer peripheral surface 56A into a toner image. A rotating brush 66 and a removing blade 68 used to remove residual toner that remains on the outer peripheral surface 56A of the image carrier 56 from the outer peripheral surface 56A are disposed downstream of the pre-charging device 58 and upstream of the charging device 60 in the rotation direction of the image carrier 56.

The image forming section 20 transfers the toner image formed on the surface of the image carrier 56 onto the transported sheet member P at a transfer position T at which the image carrier 56 is in contact with a transfer roller 70.

In addition, as illustrated in FIG. 1, the image forming section 20 also includes a fixing device 74 that fixes the toner image on the sheet member P to the sheet member P by applying heat and pressure.

Charging Device

Figure 3:
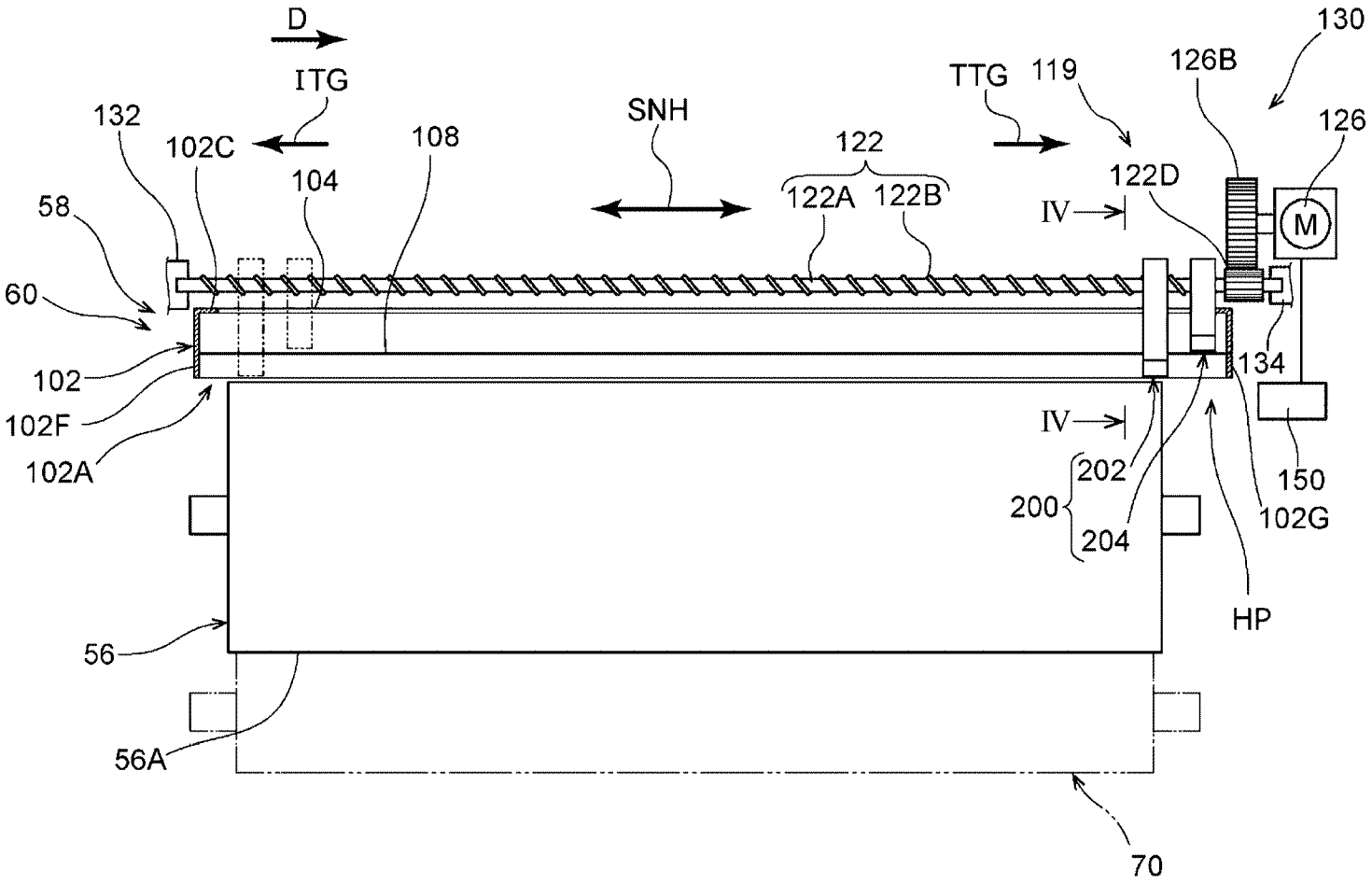
FIG. 3 is a schematic front view of an image carrier according to the exemplary embodiment.

The charging device 60 is a corotron charging device. As illustrated in FIG. 3, the charging device 60 includes a shield case 102 that serves as a housing, a charging wire 108 to which a voltage is applied, and a cleaning device 119 that cleans the wire 108.

Shield Case

The shield case 102 is made of stainless steel, and an opening 102A is formed in the shield case 102 at a side that faces the image carrier 56. The shield case 102 extends in an axial direction of the image carrier 56 (apparatus depth direction D). A long hole 104 (see FIG. 4) that extends in the apparatus depth direction D is formed in an upper wall 102C of the shield case 102.

Wire

The wire 108 is a metal wire made of, for example, tungsten, and is disposed in the shield case 102 so as to extend in the apparatus depth direction D. The direction in which the wire 108 extends is defined as a wire length direction SNH.

One end portion of the wire 108 is fixed to a first end wall 102F, which defines a wall surface of the shield case 102 at a first end ITG, with an insulator therebetween. The other end portion of the wire 108 is fixed to a second end wall 102G, which defines a wall surface of the shield case 102 at a second end TTG, with an insulator disposed therebetween. When a voltage is applied to the wire 108 by a power supply (not shown), a corona discharge occurs. Thus, the charging device 60 negatively charges the outer peripheral surface 56A of the image carrier 56.

Cleaning Device

The cleaning device 119 of the charging device 60 includes a cleaner 200 that cleans the wire 108 and a moving mechanism 130 that moves the cleaner 200 along the wire 108.

Moving Mechanism

As illustrated in FIG. 3, the moving mechanism 130 includes a lead shaft 122 that extends in the apparatus depth direction D. Both end portions of the lead shaft 122 are supported by bearings (not shown) on frames 132 and 134 of an apparatus body 10A (see FIG. 1). The lead shaft 122 is connected to a motor 126 with gears 122D and 126B provided therebetween. The motor 126 operates in accordance with a driving signal transmitted from a controller 150.

The lead shaft 122 includes a cylindrical body 122A and a helical thread 122B formed on the outer peripheral surface of the body 122A. The lead shaft 122 supports the cleaner 200. When the lead shaft 122 is rotated in a forward or reverse direction by the motor 126, the cleaner 200 is moved in the wire length direction SNH from a home position HP (see FIG. 3) at one end of the shield case 102, and cleans the surface of the wire 108.

Cleaner

Figure 4:
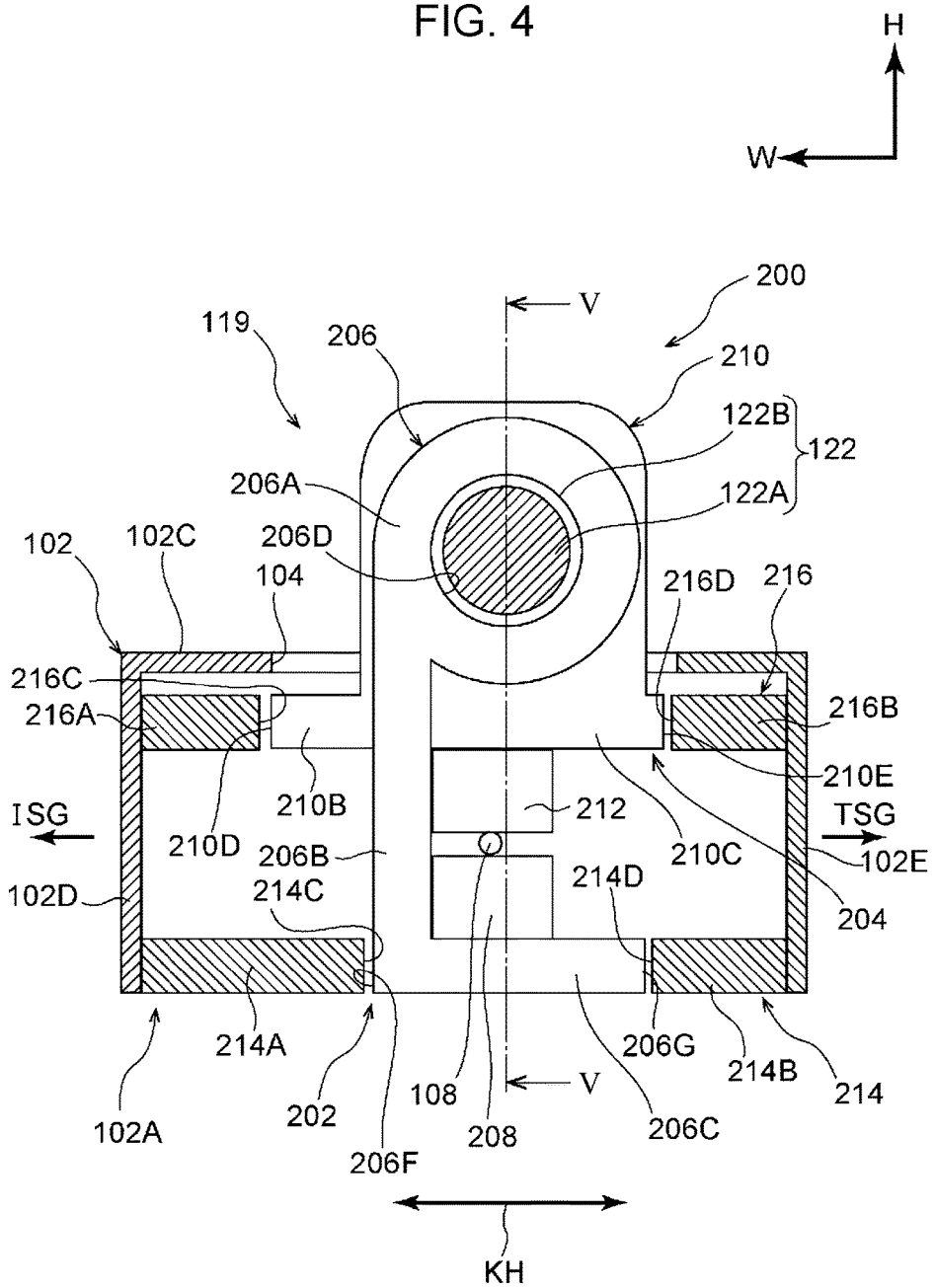
FIG. 4 is a schematic front view corresponding to a sectional view taken along line IV-IV in FIG. 3.
Figure 5:
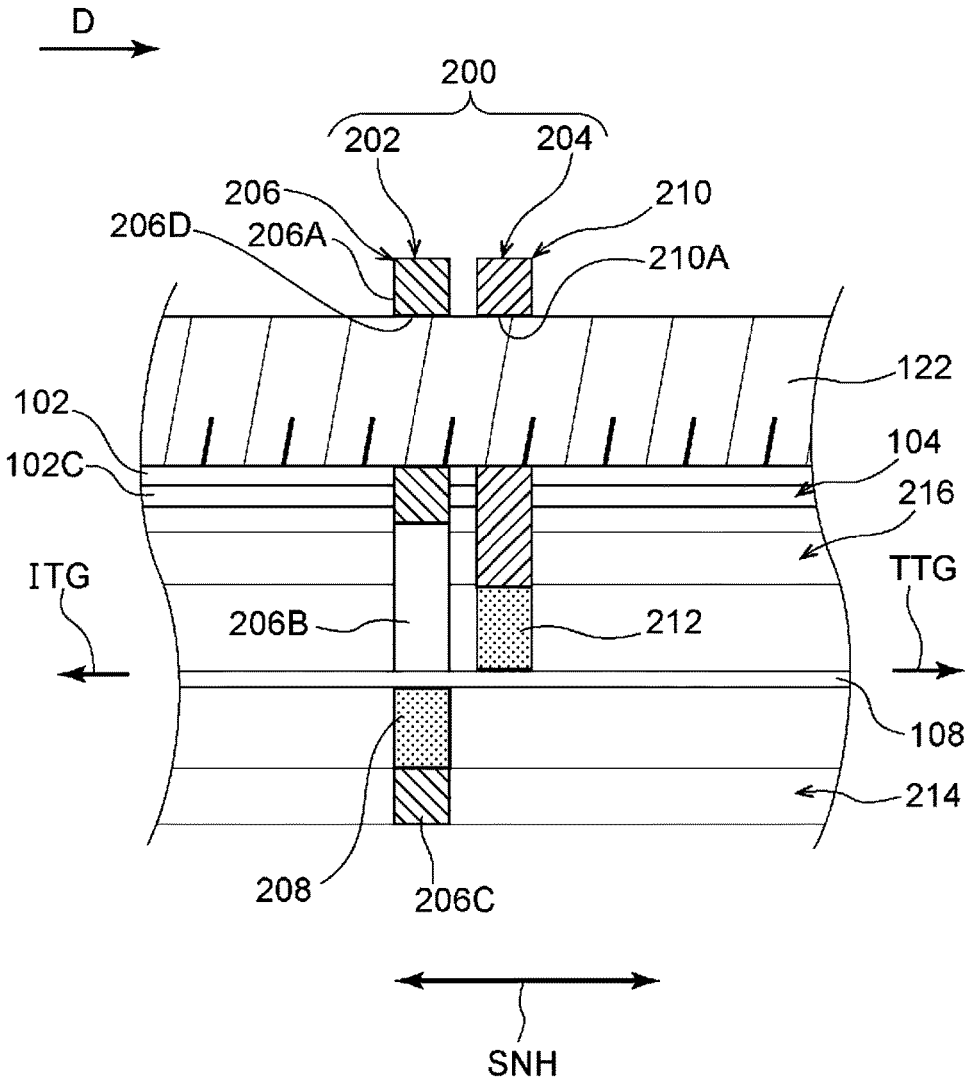
FIG. 5 is a schematic diagram corresponding to a sectional view taken along line V-V in FIG. 4.

As illustrated in FIGS. 4 and 5, the cleaner 200 includes a first cleaning member 202 and a second cleaning member 204 that move while being in contact with the wire 108 to clean the wire 108. As illustrated in FIG. 5, the second cleaning member 204 is closer to the second end TTG than the first cleaning member 202 is. Thus, the first cleaning member 202 and the second cleaning member 204 are in contact with the wire 108 at different positions in the wire length direction SNH.

Although the first cleaning member 202 and the second cleaning member 204 are in contact with the wire 108 at different positions in the wire length direction SNH in the present exemplary embodiment, the arrangement thereof is not limited to this. The first cleaning member 202 and the second cleaning member 204 may instead be disposed so as to sandwich the wire 108 at the same position.

First Cleaning Member

Figure 6B:
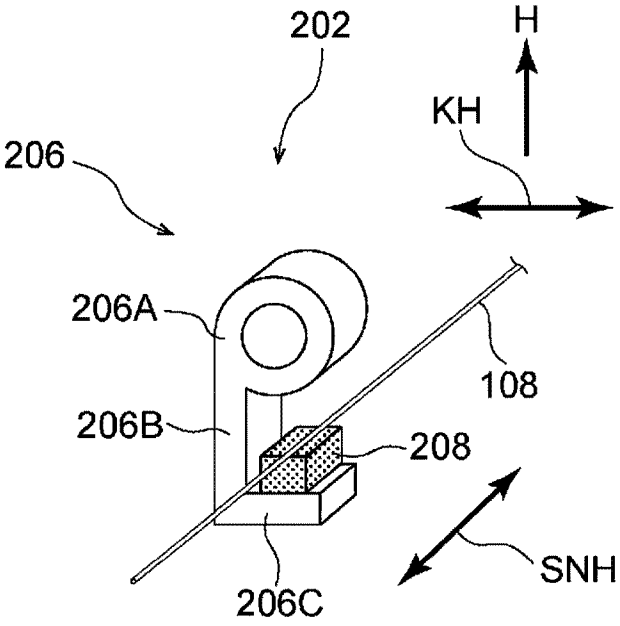
FIGS. 6A and 6B are a schematic front view and a schematic perspective view, respectively, of a first cleaning member.
Figure 6A:
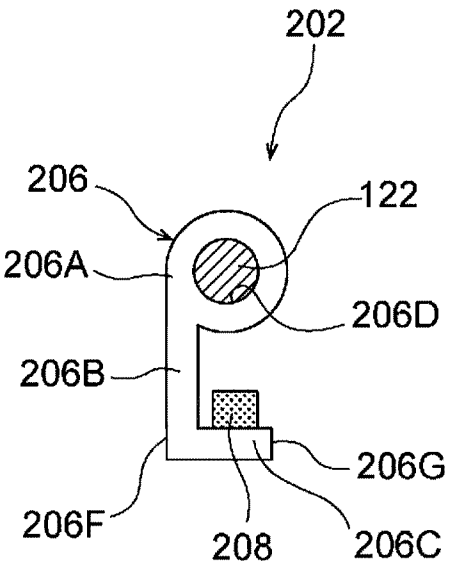

As illustrated in FIGS. 6A and 6B, the first cleaning member 202 includes a first movable member 206 that moves along the lead shaft 122 (see FIG. 3) and a first pad 208 that is rectangular-parallelepiped-shaped and provided on the first movable member 206. The first pad 208 is made of a foamed material or a nonwoven fabric.

The first movable member 206 includes a nut 206A that is attached to the lead shaft 122, an arm portion 206B that extends downward in the apparatus up-down direction H from one side of the nut 206A, and an extending portion 206C that extends sideways from an end of the arm portion 206B. The lead shaft 122 extends through a hole 206D in the nut 206A, and an internal thread that meshes with a thread 122B on the lead shaft 122 is formed on the inner peripheral surface of the hole 206D.

As illustrated in FIGS. 4 and 5, the first movable member 206 is long enough to extend through the long hole 104 in the shield case 102 to a position below the wire 108 when supported by the lead shaft 122. The extending portion 206C, which extends sideways from the arm portion 206B, is disposed below the wire 108. The first pad 208 is fixed to the top surface of the extending portion 206C. The first pad 208 is in contact with the wire 108 at the bottom, which is an example of a first side, of the wire 108. When the first cleaning member 202 moves, the first pad 208 moves in the wire length direction SNH while being in contact with the wire 108, and thereby cleans the surface of the wire 108.

Second Cleaning Member

Figure 7B:
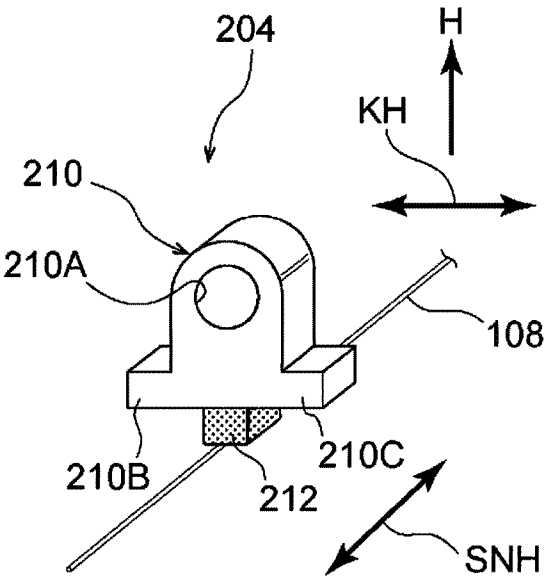
FIGS. 7A and 7B are a schematic front view and a schematic perspective view, respectively, of a second cleaning member.
Figure 7A:
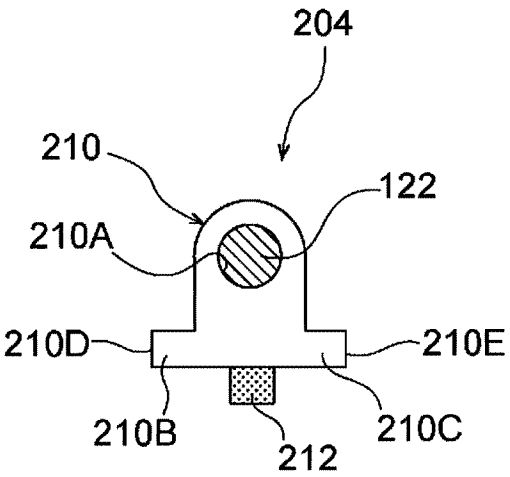

As illustrated in FIGS. 7A and 7B, the second cleaning member 204 includes a second movable member 210 that is plate-shaped and moves along the lead shaft 122 (see FIG. 3) and a second pad 212 that is rectangular-parallelepiped-shaped and provided on an end face of the second movable member 210. The second pad 212 is made of a foamed material or a nonwoven fabric. The second movable member 210 has an insertion hole 210A through which the lead shaft 122 extends, and an internal thread that meshes with the thread 122B on the lead shaft 122 is formed on the inner peripheral surface of the insertion hole 210A.

As illustrated in FIGS. 4 and 5, the second movable member 210 is long enough to extend through the long hole 104 in the shield case 102 to a position above the wire 108 when supported by the lead shaft 122 that extends through the insertion hole 210A. The second pad 212 is fixed to the bottom end face of the second movable member 210 in the apparatus up-down direction H. The second pad 212 is in contact with the wire 108 at the top, which is an example of a second side, of the wire 108. When the second cleaning member 204 moves, the second pad 212 moves in the wire length direction SNH while being in contact with the wire 108, and thereby cleans the surface of the wire 108.

Guide portions 210B and 210C project sideways from the bottom end portion of the second movable member 210. The end surfaces of the guide portions 210B and 210C serve as guide surfaces 210D and 210E.

The cleaning device 119 includes a second guide path 220, which will be described below. The second guide path 220 extends along the wire 108 and moves the second cleaning member 204 in a crossing direction KH that crosses the wire length direction SNH when the cleaner 200 moves along the wire 108.

More specifically, as illustrated in FIG. 4, a lower guide rail 214 is provided between a first side wall 102D, which defines a first side ISG of the shield case 102, and a second side wall 102E, which defines a second side TSG of the shield case 102, at the end where the opening 102A is formed. In addition, an upper guide rail 216 is provided between the first side wall 102D and the second side wall 102E of the shield case 102 at the end where the upper wall 102C is provided.

Figure 8:
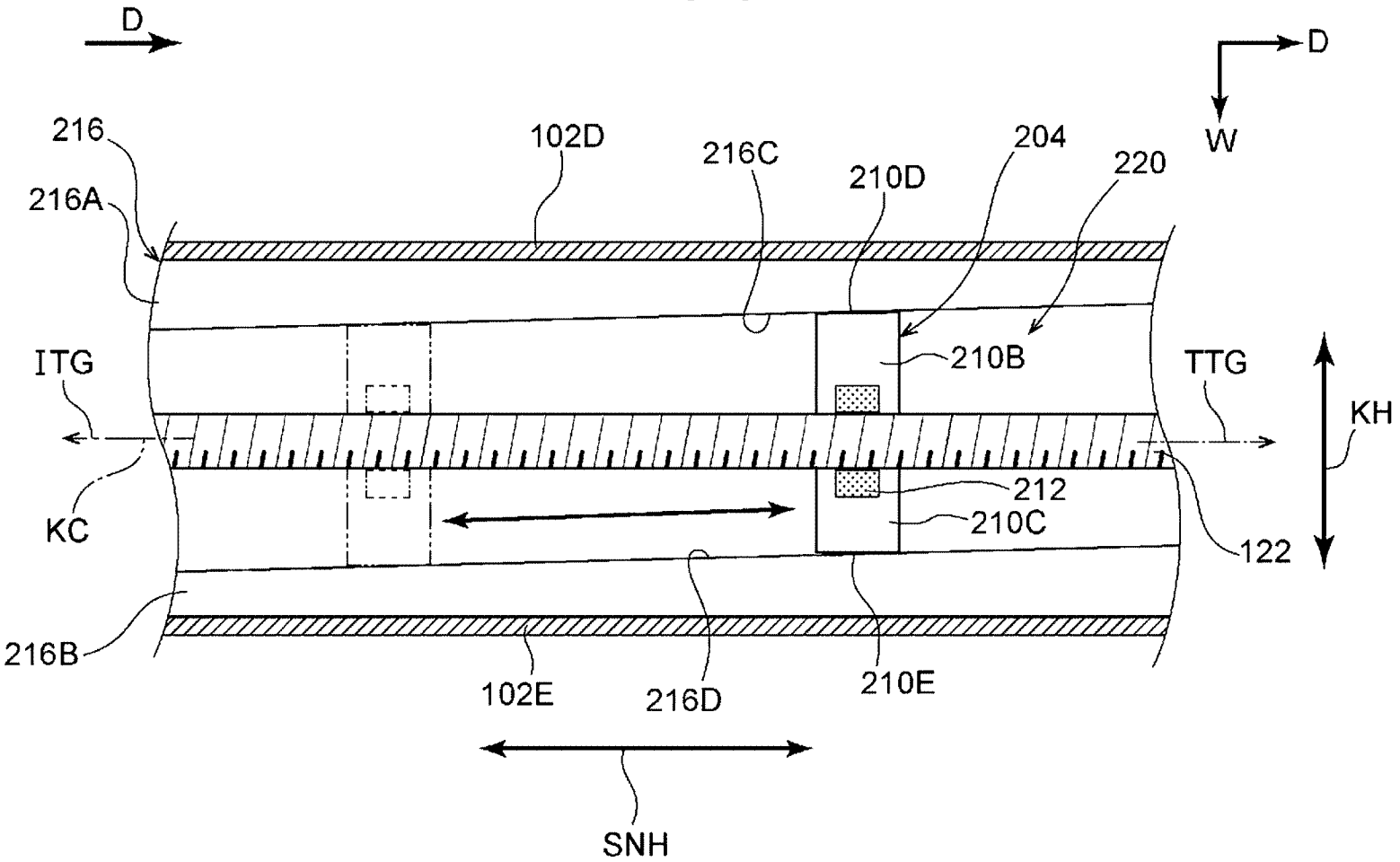
FIG. 8 is a schematic plan view illustrating the relationship between the second cleaning member and a second guide path.

As illustrated in FIG. 8, the upper guide rail 216 includes a first rail portion 216A that extends along the first side wall 102D and a second rail portion 216B that extends along the second side wall 102E. As illustrated in FIG. 4, the rail portions 216A and 216B are at the same height as the guide portions 210B and 210C of the second cleaning member 204.

The first rail portion 216A has an inner surface 216C that faces the guide surface 210D of the guide portion 210B of the second cleaning member 204, and the second rail portion 216B has an inner surface 216D that faces the guide surface 210E of the guide portion 210C of the second cleaning member 204.

As illustrated in FIG. 8, the inner surface 216C of the first rail portion 216A is at an angle with respect to the first side wall 102D (wire 108) so that the distance from a case center line KC at the center of the shield case 102 in the apparatus width direction W increases with increasing distance in the direction from the first end ITG to the second end TTG of the shield case 102 in plan view. The inner surface 216D of the second rail portion 216B is at an angle with respect to the second side wall 102E (wire 108) so that the distance from the case center line KC decreases with increasing distance in the direction from the first end ITG to the second end TTG of the shield case 102.

The inner surfaces 216C and 216D of the first and second rail portions 216A and 216B are in contact with the guide surfaces 210D and 210E of the second cleaning member 204, and guide the guide portions 210B and 210C at the free end of the second cleaning member 204 with the lead shaft 122 serving as a fulcrum. Thus, the upper guide rail 216 forms the second guide path 220, which is an example of a guide path that moves the second cleaning member 204 in the crossing direction KH by swinging (rotating) the second cleaning member 204 as the second cleaning member 204 moves in the wire length direction SNH.

Figure 9:
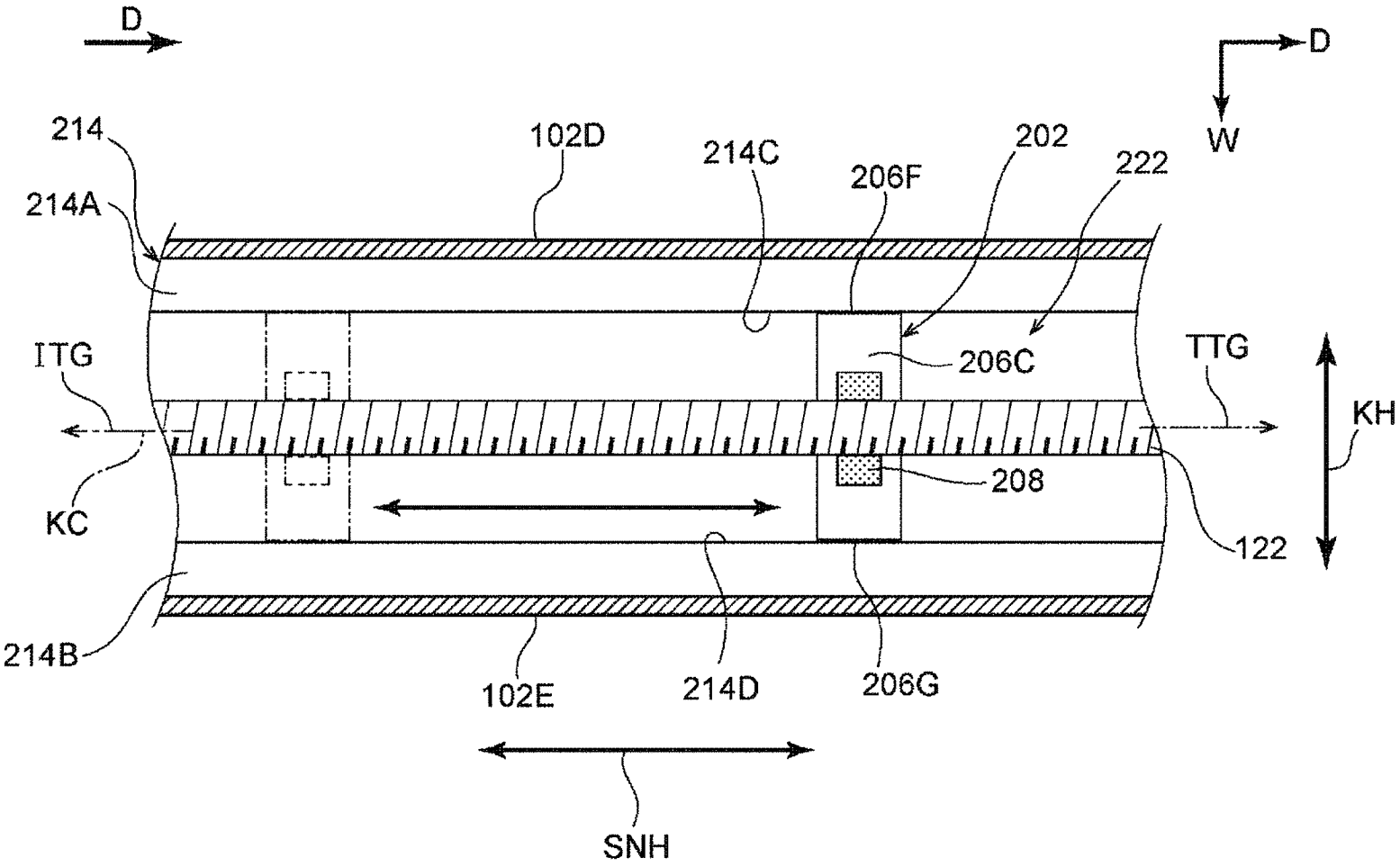
FIG. 9 is a schematic plan view illustrating the relationship between the first cleaning member and a first guide path.

As illustrated in FIG. 9, the lower guide rail 214 includes a first rail portion 214A that extends along the first side wall 102D and a second rail portion 214B that extends along the second side wall 102E. As illustrated in FIG. 4, the rail portions 214A and 214B are at the same height as the extending portion 206C of the first cleaning member 202.

The first rail portion 214A of the lower guide rail 214 has an inner surface 214C that faces one side surface 206F of the extending portion 206C of the first cleaning member 202. The second rail portion 214B has an inner surface 214D that faces the other side surface 206G of the extending portion 206C of the first cleaning member 202.

As illustrated in FIG. 9, the inner surface 214C of the first rail portion 214A of the lower guide rail 214 extends substantially parallel to the first side wall 102D of the shield case 102 (wire 108) in plan view. The inner surface 214D of the second rail portion 214B extends substantially parallel to the second side wall 102E of the shield case 102 (wire 108) in plan view.

The inner surfaces 214C and 214D of the first and second rail portions 214A and 214B of the lower guide rail 214 are in contact with the first cleaning member 202, and guide the first cleaning member 202. Thus, the lower guide rail 214 forms a first guide path 222 that guides the first cleaning member 202 so that the first cleaning member 202 moves along the wire 108 as the first cleaning member 202 moves in the wire length direction SNH.

The first cleaning member 202 is guided by the first guide path 222 so as to move along the wire 108. The second cleaning member 204 is guided by the second guide path 220 so that the free end thereof moves along a path that is at an angle with respect to the wire 108 with the lead shaft 122 serving as a fulcrum. Accordingly, the first pad 208 of the first cleaning member 202 and the second pad 212 of the second cleaning member 204 clean the surface of the wire 108 by moving in the wire length direction SNH while moving relative to each other in the crossing direction KH.

The operation of the above-described structure according to the present exemplary embodiment will now be described.

When the wire 108 is to be cleaned, the lead shaft 122 is rotated so that the cleaner 200 that is in a standby state at the home position HP is moved from the second end TTG to the first end ITG in the wire length direction SNH. Accordingly, the first pad 208 of the first cleaning member 202 and the second pad 212 of the second cleaning member 204 of the cleaner 200 move while being in contact with the wire 108, thereby cleaning the wire 108 by removing dirt, such as corona products, external additives, and toner, from the surface of the wire 108.

At this time, the first pad 208 of the first cleaning member 202 and the second pad 212 of the second cleaning member 204, which move while being in contact the wire 108, move relative to each other in the crossing direction KH of the wire 108. Accordingly, the position at which the pads 208 and 212 are in contact with the wire 108 change.

More specifically, when the cleaning members 202 and 204 move toward the first end ITG, the first pad 208 of the first cleaning member 202 moves along the wire 108, as illustrated in FIG. 9. However, as illustrated in FIG. 8, the second pad 212 of the second cleaning member 204 moves along a path that is at an angle with respect to the wire 108.

Figure 10A:
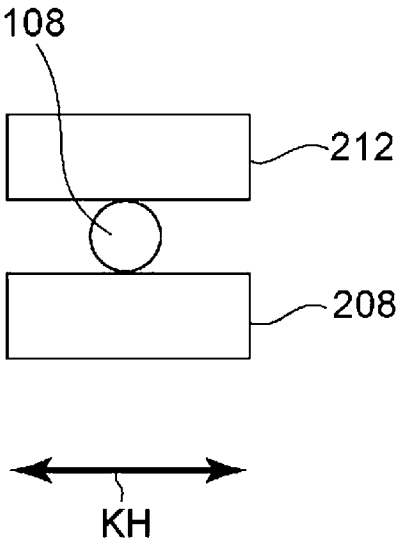
FIGS. 10A to 10C illustrate a movement of the second cleaning member relative to the first cleaning member.
Figure 10B:
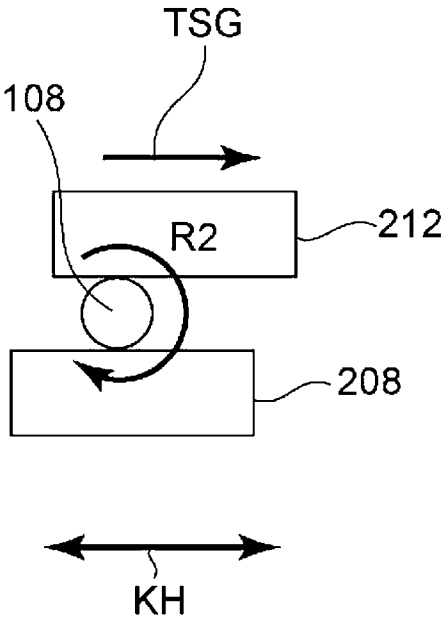

Accordingly, as illustrated in FIGS. 10A and 10B, the second pad 212 moves relative to the first pad 208 toward the second side wall 102E of the shield case 102 (see FIG. 4), that is, toward the second side TSG. Accordingly, the wire 108 rotates in rotation direction R2 and rolls toward the second side TSG along the first pad 208. Therefore, the peripheral surface of the wire 108 may be cleaned over a large area. Thus, the image forming apparatus 10 is capable of forming images with fewer defects than in the case where the cleaning members 202 and 204 that are in contact with the wire 108 move only in the wire length direction SNH.

When the wire 108 rolls, the wire 108 is twisted in rotation direction R2. However, the cleaning members 202 and 204 that have reached the first end ITG of the shield case 102 (see FIG. 3) start to return to the second end TTG.

Figure 10C:
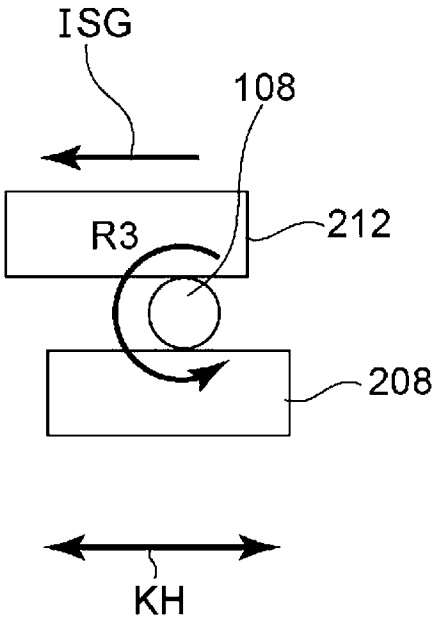

At this time, as illustrated in FIGS. 10B and 10C, the second pad 212 moves relative to the first pad 208 toward the first side wall 102D of the shield case 102 (see FIG. 4), that is, toward the first side ISG. Accordingly, the wire 108 rotates in rotation direction R3 and rolls toward the first side ISG along the first pad 208. Therefore, the wire 108 is untwisted and the peripheral surface of the wire 108 may be cleaned over a large area in the circumferential direction.

In addition, the amount of wear of the pads 208 and 212 of the cleaning members 202 and 204 at specific positions is smaller than that in the case where the positions at which the pads 208 and 212 of the cleaning members 202 and 204 are in contact with the wire 108 do not change. Accordingly, the lives of the pads 208 and 212 are increased. As a result, the durabilities of the cleaning members 202 and 204 are increased. Thus, the image forming apparatus 10 includes highly durable cleaning members 202 and 204.

The second guide path 220, which is at an angle relative to the wire 108, guides the free end of the second cleaning member 204 so that the second pad 212 moves relative to the first pad 208 in the crossing direction KH as the cleaning members 202 and 204 move.

Accordingly, the structure is simpler than in the case where the second pad 212 is moved in the crossing direction KH by driving the second cleaning member 204 with a driving device.

The first pad 208 and the second pad 212 are in contact with the wire 108 at different positions in the wire length direction SNH. Accordingly, unlike the case in which the first pad 208 and the second pad 212 are arranged so as to face each other, no frictional force is generated between the pads 208 and 212, and the pads 208 and 212 are easily movable relative to each other.

In the present exemplary embodiment, the charging device 60 is a corotron charging device. However, the charging device 60 is not limited to this, and may instead be a scorotron charging device.

In the present exemplary embodiment, the second pad 212 moves along a path that is at an angle with respect to the wire 108. However, the movement of the second pad 212 is not limited to this, and the second pad 212 may instead move along a path that meanders with respect to the wire 108.

In the present exemplary embodiment, the second pad 212 is moved relative to the first pad 208 in the crossing direction KH by swinging (rotating) the free end of the second cleaning member 204 with the lead shaft 122 serving as a fulcrum. However, the present invention is not limited to this, and the second pad 212 may instead be moved relative to the first pad 208 in the crossing direction KH by sliding a bottom end portion of the second cleaning member 204 including the guide portions 210B and 210C relative to the remaining portion of the second cleaning member 204.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a first cleaning member that cleans a surface of a charging wire by moving along the wire while being in contact with the wire at a first side; and a second cleaning member that cleans the surface of the wire by moving while being in contact with the wire at a second side, and moving relative to the first cleaning member in a crossing direction that crosses a wire length direction.

2. The charging device according to claim 1, further comprising:

a guide path that extends along the wire and guides the second cleaning member to move the second cleaning member in the crossing direction as the second cleaning member moves along the wire.

3. The charging device according to claim 2, wherein the first cleaning member and the second cleaning member are in contact with the wire at different positions in the wire length direction.

4. The charging device according to claim 1, wherein the first cleaning member and the second cleaning member are in contact with the wire at different positions in the wire length direction.

5. An image forming apparatus comprising:

an image carrier that rotates;

the charging device according to claim 1 that charges an outer peripheral surface of the image carrier;

an exposure device that forms an electrostatic latent image by irradiating the outer peripheral surface of the image carrier charged by the charging device with exposure light; and a developing device that develops the electrostatic latent image formed on the outer peripheral surface of the image carrier by the exposure device into a toner image.

* * * * *